US005774890A

United States Patent [19]

Shah

[11] Patent Number: 5,774,890

[45] Date of Patent: Jul. 7, 1998

[54] PERSONAL SANITARY BARRIER DEVICE

[76] Inventor: Saroj Shah, 454 E. Shore Rd., Great Neck, N.Y. 11024

[21] Appl. No.: 588,448

[22] Filed: Jan. 18, 1996

[51] Int. Cl.[6] ..... A41B 1/00

[52] U.S. Cl. ..... 2/22; 2/400; 2/69

[58] Field of Search ..... 2/22, 1, 46, 242, 2/78.2, 214, 69, 51, 114, 227, 228, 238, 400–408; 128/856

[56] References Cited

U.S. PATENT DOCUMENTS

| | | | |
|---|---|---|---|
| 921,435 | 5/1909 | Miller . | |
| 1,364,002 | 12/1920 | Shirley . | |
| 1,512,171 | 10/1924 | Homling . | |
| 1,704,887 | 3/1929 | Flavell et al. . | |
| 2,010,483 | 8/1935 | Goodman . | |
| 3,521,301 | 7/1970 | Cowen | 2/114 |
| 3,828,369 | 8/1974 | Swallow . | |
| 3,916,447 | 11/1975 | Thompson | 2/114 |
| 4,349,019 | 9/1982 | Singer . | |
| 4,513,740 | 4/1985 | Westlake . | |
| 4,964,176 | 10/1990 | Previdi | 2/22 |
| 5,146,932 | 9/1992 | McCabe . | |
| 5,362,306 | 11/1994 | McCarver et al. | 128/856 |

*Primary Examiner*—Gloria M. Hale

*Attorney, Agent, or Firm*—Cushman Darby & Cushman, IP Group of Pillsbury Madison & Sutro LLP

[57] ABSTRACT

Personal sanitary thigh wraps provide protection from transmission of fluid-borne germs by preventing contact between a toilet seat and the user's bare skin. A thigh wrap is placed around the circumference of each thigh, and the overlapping edges of the wrap are fastened at the front of the thigh with an adhesive material to minimize the chance of contact between the user's hands and the potentially soiled portion of the wrap. After use, the wrap can be either flushed or disposed in a conventional waste disposal container. The thigh wraps are preferably made of a moisture impermeable material to prevent absorption of urine or fecal matter through the wrap.

18 Claims, 5 Drawing Sheets

PERSONAL SANITARY BARRIER DEVICE

BACKGROUND OF THE INVENTION

1. Field of the Invention

The present invention relates to a personal sanitary barrier device for maintaining personal hygiene and cleanliness, particularly in connection with the use of public or communal toilet facilities.

2. Description of Related Art

Certain methods for maintaining personal cleanliness and hygiene in conjunction with toilet use are known.

A known toilet hygiene device is a shaped (commonly, horse-shoe shaped) portion of a sheet material which is manually positioned so as to rest on the toilet seat. This type of toilet seat cover has several distinct disadvantages.

First, the toilet seat cover is typically made from absorbent paper, in part due to economical reasons. Accordingly, this type of seat cover does not actually provide significant or beneficial barrier protection from urine or moist feces because of the absorptive nature of the paper. In turn, little or no protection is offered against fluid-borne germs and the like, which are transmitted to the skin due to the absorbency of the paper.

Second, the above-described paper seat cover frequently does not accurately fit on the toilet seat, thereby potentially leaving a portion of the toilet seat exposed to the bare skin.

Third, the above-described paper seat cover is typically not fixed in position on the toilet seat after being manually positioned thereon. Therefore, the seat cover tends to shift about, thereby increasing the likelihood of exposing the bare skin to the toilet seat due to misalignment.

Fourth, after use, the potentially soiled seat cover must be manually handled for disposal, thereby raising the possibility of transmitting microorganisms on the hands.

Fifth, an individual must typically rely on others to provide such seat covers, especially at public toilet facilities.

Another form of toilet hygiene maintenance is provided by antiseptic sprays or wipes. This method also has certain disadvantages.

First, a delay typically ensues while permitting the antiseptic to provide its germicidal benefit.

Second, the antiseptic typically must be wiped from the toilet seat, so as to not subsequently irritate the bare skin. In addition, the need for wiping the toilet seat increases one's contact with the toilet seat, thereby increasing the possibility of microorganism transmission.

Third, antiseptic sprays are relatively expensive.

SUMMARY OF THE INVENTION

It is therefore an objective of the present invention to provide a device for hygienically protecting an individual during the use of a toilet, and specifically, for protecting an individual from microorganism transmission from the toilet seat.

It is a secondary objective of the present invention to provide a personal hygiene device in accordance with the first objective set forth above, which is convenient, reliable, and effective.

The foregoing objectives are realized by a barrier-type sanitary thigh wrap device, which includes two moisture-resistant or moisture-proof material portions which are securable about at least a portion of the circumferential periphery of each thigh, so as to provide a germ-resistant barrier between the bare skin of the thighs and a toilet seat cover during toilet use.

Other objectives, features, and characteristics of the present invention, as well as methods of operation and function of the related elements of structure, and the combination of parts and economies of manufacture, will become more apparent upon consideration of the following detailed description with reference to the accompanying drawings, all of which form a part of this specification.

BRIEF DESCRIPTION OF THE DRAWINGS

It is emphasized that the accompanying figures merely illustrate examples of the present invention and should not be construed to limit the scope of the invention.

DETAILED DESCRIPTION OF PREFERRED EMBODIMENTS

Sanitary thigh wraps according to the present invention generally include two portions of a moisture-resistant or moisture-proof material which are fixed to at least a portion of the circumferential periphery of each thigh, particularly so as to provide a barrier between at least the rear surface of each thigh and a toilet seat.

Figure 1:
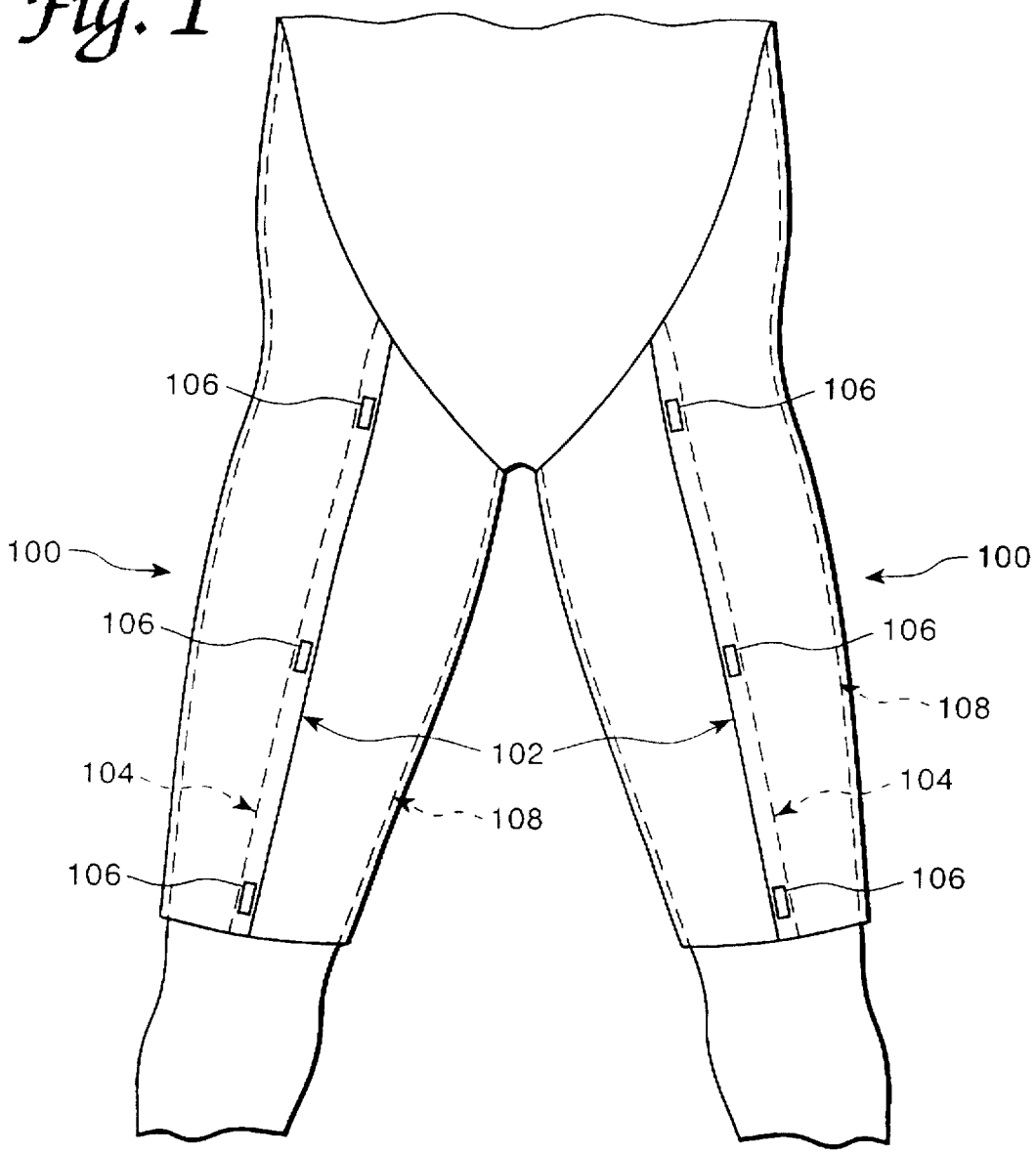
FIG. 1 is a partial front view of a human torso, which illustrates the use of the sanitary thigh wraps according to the present invention in an exemplary arrangement thereof.
Figure 2:
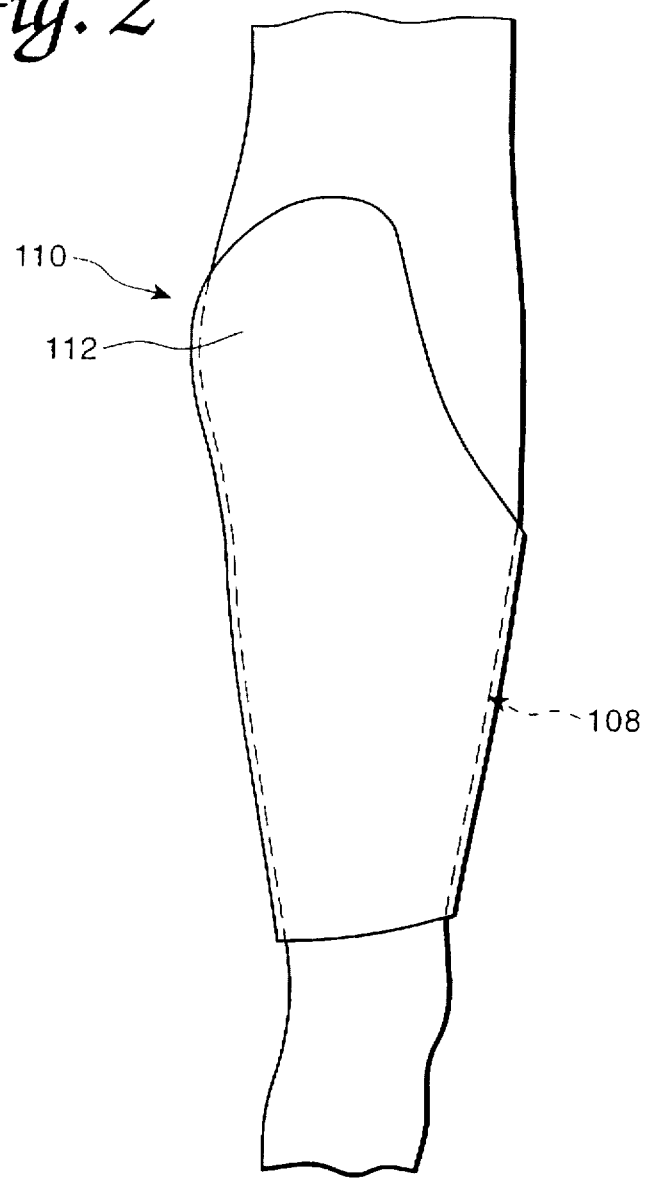
FIG. 2 is a partial right view of a human torso, illustrating the use of the sanitary thigh wraps corresponding to the example seen in FIG. 1.
Figure 3:
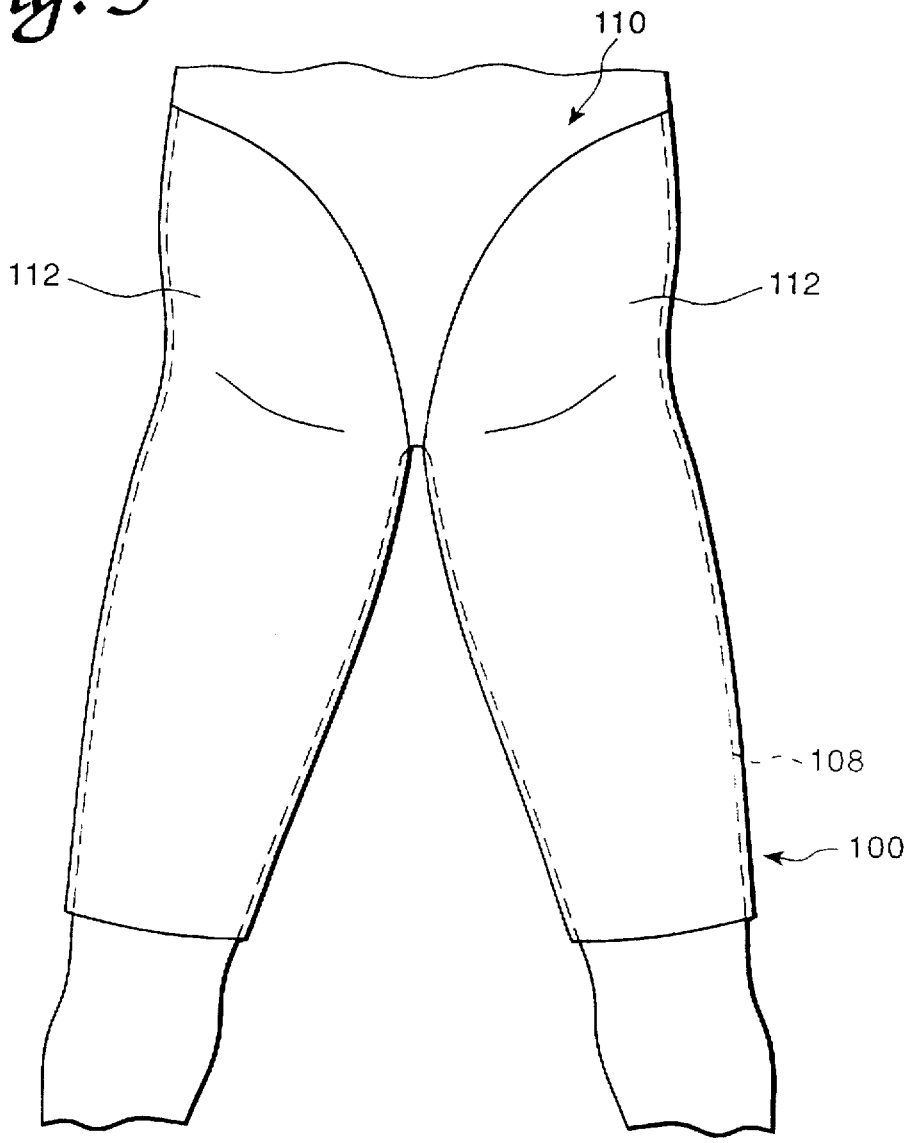
FIG. 3 is a partial rear view of a human torso, illustrating the use of the sanitary thigh wraps corresponding to the example seen in FIGS. 1 and 2.

FIG. 1 illustrates a front view of a first example of sanitary thigh wraps according to the present invention, as worn by an individual. FIG. 2 is a side view of the first example of the thigh wraps of FIG. 1, and FIG. 3 is a corresponding rear view.

Each thigh wrap 100 is made from a thin pliable material portion which wraps around a periphery of at least part of the thigh 108 of the user (seen in phantom within the thigh wrap 100), with the thigh including the portion of the upper leg between about the intersection of the femur and the pelvis, axially down the leg to approximately the knee.

Each thigh 108 is wrapped by a respective thigh wrap 100. In general, each thigh wrap 100 closely conforms to the shape of the thigh 108, as seen in FIG. 1. The thigh wraps 100, as seen generally in FIGS. 1 and 3, leave the perineal area of the torso exposed to allow the user to freely urinate or defecate.

In a preferred example, each thigh wrap 100 has respective longitudinal (i.e., along the length of the thigh) edges 102 and 104 which overlap one another when the thigh wrap 100 is suitably positioned around the thigh 108. The overlapping edge, (in this case, edge 102), is then fixed to the other, underlying edge (in this case, edge 104). The overlapping edge can be fixed to the underlying edge with, for example, an adhesive (in particular, an adhesive portion having a protective paper backing which is peeled away prior to use) or engaging loop and hook material portions, such as that sold under the trademark "Velcro". Bearing in mind that the thigh wraps 100 according to the present invention are to be inexpensive and convenient to use, fastening portions 106 are preferably provided at spaced apart intervals along overlapping edges 102, 104, as seen in FIG. 1, instead of, for example, providing a continuous strip of adhesive or strips of the engaging loop and hook material portions.

More particularly, each thigh wrap 100 is positioned on the thigh 108 so that the "seam" formed by the overlapping edges 102, 104 is positioned substantially at the front of the thigh 108, as seen in FIG. 1. Accordingly, the coverage of the material at the back of the thigh, which opposes the toilet seat, is substantially continuous. This arrangement, therefore, helps to prevent leakage, or other seepage or migration, of excreta past the thigh wrap 100 via edges 102, 104 and into contact with the bare skin of the thigh 108.

This arrangement is generally advantageous because the overlapping edges 102, 104 are provided at, and can be manipulated at, the front part of the thigh, opposite the rear surface of the thigh, which part of the thigh wraps 100 is most likely to be soiled during toilet use. In particular, after the user is finished using the toilet and the thigh wraps are being removed, the user's hands necessarily remain spatially separated from potentially soiled portions of the thigh wraps, thereby reducing the opportunity for contact contamination of the hands.

In another example of the thigh wraps according to the present invention, but not illustrated here, each thigh wrap is made from a circumferentially continuous, or tubular, material portion, like a sleeve. In this instance, each thigh wrap is positioned around the thigh by first putting the foot through the thigh wrap and then sliding it up the leg to its desired position around the thigh.

In general, the thigh wraps according to the present invention can be manufactured in different sizes (for example, small, medium, or large, or with incremental variation, perhaps associated with height) to suit different individuals and to maximize comfort and convenience during use.

Furthermore, in order to maintain the thigh wraps in a desirable position, they may, for example, rely only on the circumferential constriction of the thigh wraps about the thighs, according to the snugness with which the overlapping edges are fixed to one another. In another example (not illustrated here), elastic material, such as elastic bands may be provided at, for example, uppermost and lowermost circumferential edges of each thigh wrap to help hold the thigh wraps around the respective thighs.

As noted above, the thigh wraps according to the present invention are made from a thin, pliable, and generally moisture-impermeable (moisture-resistant or moisture-proof) material. Moisture-impermeable here denotes that which provides a moisture barrier sufficient to prevent gross absorption and transmission of moisture, in contrast to, for example, a paper napkin. In general, the material used to make the thigh wraps described here is preferably comfortable and non-irritating to the bare skin, and is relatively low cost. It must, of course, be compatible with common forms of waste disposal, such as flushing, or by being deposited in a waste container. Finally, should the material of manufacture have characteristic pores or interstitial spaces therein, these pores or spaces should be small enough to substantially preclude passage of microbes, as well as moisture, therethrough, so as to provide an effective microbial barrier.

A preferred example of a material suitable for use here is a thin plastic film covered on one or both sides by a paper backing. This type of material is commonly known in the medical field as "Chux" and also "Underpad" (the latter being made by Inbrand of Georgia) and is used in patient examination gowns, sheeting to cover examination tables, and bibs for oral examination. This provides reliable barrier protection while affording tactile comfort, due to the use of paper, rather than plastic, next to the skin.

Thin, preferably non-clinging, plastic materials may also be used, such as polyethylene or polypropylene of a thickness and grade commonly seen in food storage bags and wrapping material and the like. It is noted such plastic materials are deemed suitable for this use because of the relatively short time that the thigh wrap is actually in use.

The thigh wraps according to the present invention also can have different "cuts" or shaping. For example, as seen in FIGS. 1–3, the upper rear portion of each thigh wrap 100 is shaped so as to extend up to the sides of the pelvis and cover at least a portion of the buttocks 110 with portion 112. This arrangement increases the extent of barrier protection for the user during toilet use.

Figure 4:
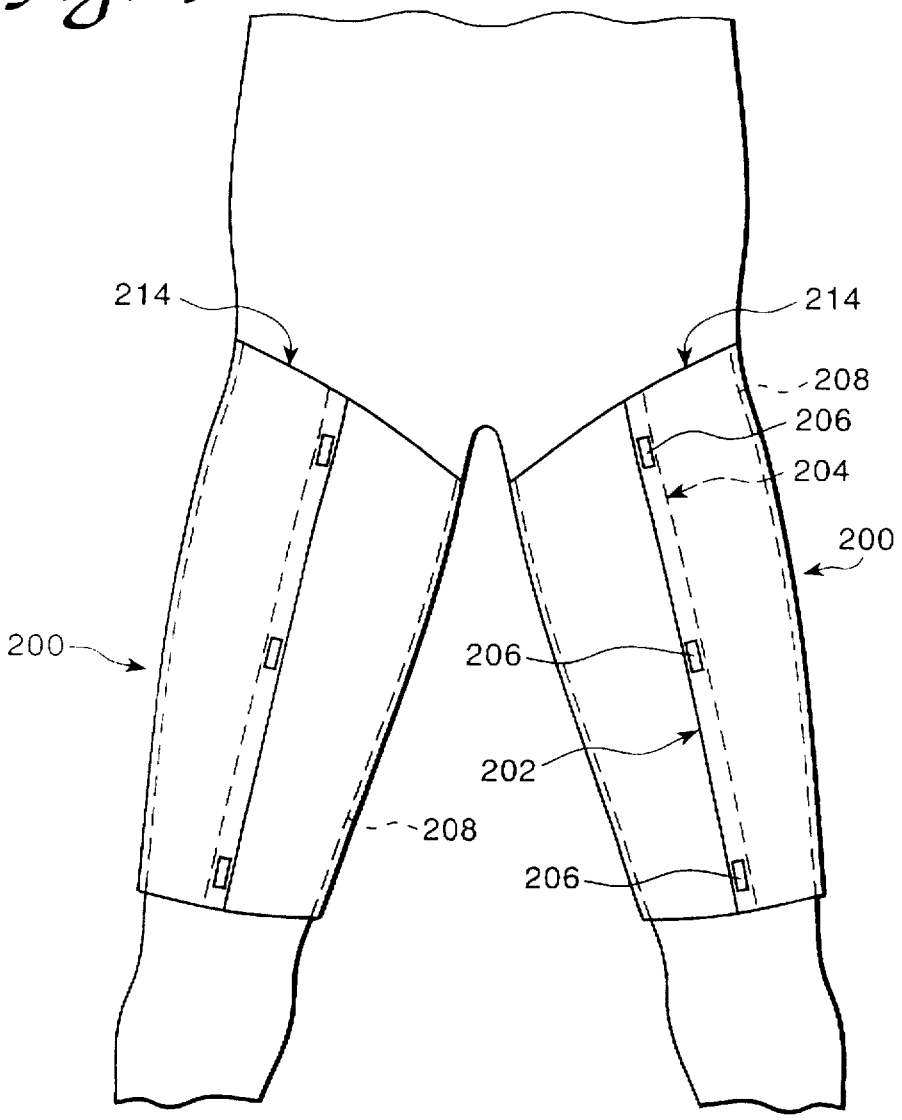
FIG. 4 is a partial front view of a human torso, illustrating another arrangement for using the sanitary thigh wraps according to the present invention.
Figure 5:
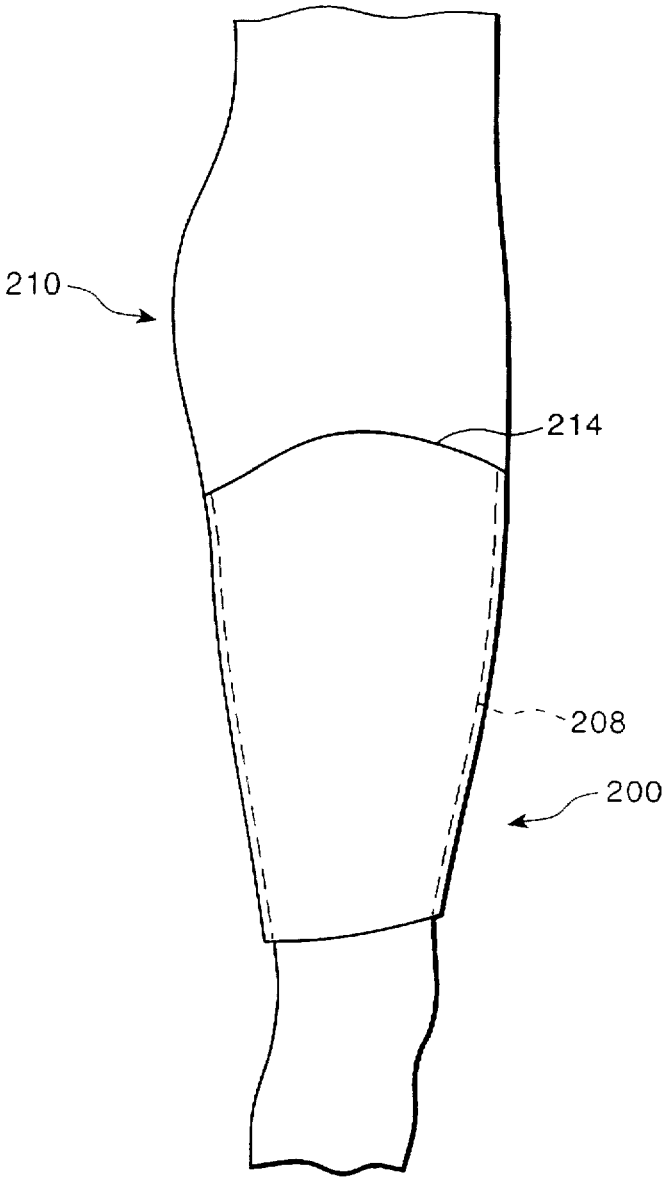
FIG. 5 is a partial left side view of a human torso, illustrating the use of the sanitary thigh wraps corresponding to the example seen in FIG. 4.

In an example of a different "cut", FIGS. 4 and 5 illustrate the use of thigh wraps 200, as seen in a front view and a side view, respectively. The use and benefits of thigh wraps 200 are very similar to thigh wraps 100 seen in FIGS. 1–3. Each thigh wrap 200 in FIG. 4 and FIG. 5, like that described previously, includes a material portion wrapped around the thigh 208 and fixed, for example, by fixing overlapping edges 202, 204 at fastening portions 206. As before, the overlapping edges 202, 204 are preferably disposed at substantially the front of the thigh 208 for reasons discussed earlier.

The "cut" of thigh wraps 200 differs from that of thigh wraps 100 in that thigh wraps 200 each have an uppermost edge 214 which extends substantially laterally about the circumference of the thigh 208. This leaves the buttocks 210 more exposed than in the first example of the thigh wraps described above, in contrast with the shape of thigh wraps 100. The "cut" of thigh wraps 200 could, for example, be suitable for an individual who tends to lean forward while seated on a toilet seat, so that the buttocks do not substantially contact the toilet seat.

In another example of the thigh wraps according to the present invention (but not illustrated here), a material portion is positioned on at least the rear portion of each thigh, and is secured thereto by strips of the same or different material which extend around the leg and which are secured by, for example, tying, adhesive, or loop and hook material portions, as above. This has an advantage of reducing the amount of material used in manufacturing the thigh wraps, thereby reducing the cost of manufacture.

While the invention has been described in connection with what is presently considered to be the most practical and preferable embodiments, it is to be understood that the invention is certainly not limited to these disclosed embodiments, but, on the contrary, is intended to cover various modifications and equivalent arrangements.

What is claimed is:

1. A personal sanitary barrier device for use by a wearer of the barrier device while seated on a toilet comprising:

two sheet material portions, each said sheet material portion being adapted to be removably fitted at least partially around a periphery of a thigh of said wearer, wherein each said sheet material portion is made from a substantially moisture-impermeable material and is adapted to cover a posterior portion of the wearer which would otherwise contact the toilet, allowing the wearer to sit on the toilet without making direct contact with the toilet;

wherein said sheet material portions are made from a plastic film with a paper backing on at least one side thereof.

2. A device as claimed in claim 1, wherein said sheet material portions comprise a material effective to prevent at least some microbial organisms from passing therethrough.

3. A device as claimed in claim 1, wherein said sheet material portions are sized and configured to leave the perineal area of said wearer exposed.

4. A device as claimed in claim 1, wherein each said sheet material portion has a size corresponding to the human thigh.

5. A device as claimed in claim 1, wherein said sheet material portions are adapted to also cover at least a portion of the buttocks.

6. A device as claimed in claim 1, wherein each said sheet material portion is adapted to substantially conform with the thigh.

7. A personal sanitary barrier device for use by a wearer of the barrier device while seated on a toilet comprising:

two sheet material portions, each said sheet material portion being adapted to be removably fitted at least partially around a periphery of a thigh of said wearer, wherein each said sheet material portion is made from a substantially moisture-impermeable material and is adapted to cover a posterior portion of the wearer which would otherwise contact the toilet, allowing the wearer to sit on the toilet without making direct contact with the toilet;

wherein each said sheet material portion is provided with at least one attachment device at a first location, said attachment device being removably engagable with a second location on said sheet material portion such that upon engagement of said attachment device to said second location, said sheet material portion can be fitted around said periphery of said thigh.

8. A device as claimed in claim 7, wherein said attachment device is an adhesive portion, said adhesive portion being adhesively engagable with said second location such that said sheet material portion can be fitted around said periphery of said thigh.

9. A device as claimed in claim 7, wherein said attachment device is a hook portion of a hook-loop fastener and wherein a corresponding loop portion of said hook-loop fastener is provided at said second location.

10. A personal sanitary barrier device for use by a wearer of the barrier device while seated on a toilet comprising:

two sheet material portions, each said sheet material portion being adapted to be removably fitted at least partially around a periphery of a thigh of said wearer, wherein each said sheet material portion is made from a substantially moisture-impermeable material and is adapted to cover a posterior portion of the wearer which would otherwise contact the toilet, allowing the wearer to sit on the toilet without making direct contact with the toilet;

wherein each said sheet material portion has opposing axially-extending edges which are engagable with one another at an anterior portion of the thigh.

11. A device as claimed in claim 10, wherein said sheet material portions comprise a material effective to prevent at least some microbial organisms from passing therethrough.

12. A device as claimed in claim 10, wherein said sheet material portions are made from a plastic film with a paper backing on at least one side thereof.

13. A device as claimed in claim 10, wherein said sheet material portions are sized and configured to leave the perineal area of said wearer exposed.

14. A device as claimed in claim 10, wherein each said sheet material portion is provided with an attachment device disposed on one of said opposing axially-extending edges, said attachment device being constructed and arranged to engage said axially-extending edges with each other so that said sheet material portion can be fitted around said periphery of said thigh.

15. A device as claimed in claim 14, wherein said attachment device is an adhesive portion.

16. A device as claimed in claim 14, wherein said attachment device is a hook-loop fastener.

17. A device as claimed in claim 10, wherein said sheet material portions are adapted to also cover at least a portion of the buttocks.

18. A device as claimed in claim 10, wherein each said sheet material portion is adapted to substantially conform with the thigh.

* * * * *